United States Patent [19]

Williamson

[11] 3,962,959

[45] June 15, 1976

[54] METHOD OF MAKING DISPOSABLE CONTAINER FOR BULK MATERIALS

[75] Inventor: Robert R. Williamson, Dallas, Tex.

[73] Assignee: Better Agricultural Goals Corporation, Dallas, Tex.

[22] Filed: Dec. 16, 1974

[21] Appl. No.: 533,461

Related U.S. Application Data

[63] Continuation-in-part of Ser. No. 460,053, April 11, 1974.

[52] U.S. Cl. ..... 93/35 R; 93/8 W; 93/36.8; 93/54.1; 156/192; 156/195

[51] Int. Cl.[2] ..... B31B 39/00

[58] Field of Search ..... 93/35 R, 35 VL, 35 DS, 93/35 PC, 54.1, 77 CL, 8 W, 8 VB, 8 R, 94 R, 77 R, 81 R, 80, 39 C, 36.8; 222/181; 150/1; 156/192, 193, 195

[56] References Cited

UNITED STATES PATENTS

| | | | |
|---|---|---|---|
| 2,008,218 | 7/1935 | McColl | 93/39 C X |
| 2,951,003 | 8/1960 | Stephens | 156/193 X |
| 3,374,929 | 3/1968 | Silfverskiold | 222/181 X |
| 3,788,918 | 1/1974 | Poulsen | 156/195 X |
| 3,789,897 | 2/1974 | Saito | 222/181 X |

FOREIGN PATENTS OR APPLICATIONS

| | | | |
|---|---|---|---|
| 561,062 | 10/1932 | Germany | 93/54.1 |
| 413,476 | 12/1966 | Switzerland | 222/181 |

*Primary Examiner*—James F. Coan
*Attorney, Agent, or Firm*—Richards, Harris and Medlock

[57] ABSTRACT

Disclosed is a method for manufacturing flexible containers for use in transportation, storage and handling of flowing materials wherein one edge of a length of flexible sheet material is positioned on a cylindrical mandrel. Next, the edge is affixed to the mandrel with a first length of double-backed adhesive tape and extending the double-backed adhesive tape beyond the width of the sheet material and onto the ends of the mandrel. The mandrel is then rotated to wrap the sheet material about the mandrel to overlap and adhere to the first length of adhesive tape to form the first cylindrical wall. A second length of double-backed adhesive tape is applied on the exterior of the sheet material extending from the first wall. The mandrel is rotated to wrap the material about the first cylindrical wall to overlap and adhere to the second length of adhesive tape to form a second cylindrical wall. The sheet material is severed at the edge of the second wall. The first wall is gathered at one end and is tied. The second wall is gathered at said one end and is tied. An adhesive material is applied to the exterior of said second wall adjacent said first end. A filament is wrapped in a helix about said second wall and adhesively attached to the second wall. A sling is positioned around the exterior of said second wall with the gathered ends of said first and second walls within first and second concentric circular portions on said sling, and with support loops joined to said circular portions and extending along the exterior surface of the second wall. An outer covering is adhesively attached and around the exterior of said sling. According to a second embodiment, the inner and outer walls are formed on said mandrel by positioning first and second concentric cylindrical walls on said mandrel, and thereafter performing the steps of the first embodiment.

30 Claims, 14 Drawing Figures

METHOD OF MAKING DISPOSABLE CONTAINER FOR BULK MATERIALS

REFERENCE TO RELATED APPLICATIONS

This application is a continuation-in-part of a prior application filed Apr. 11, 1974, Ser. No. 460,053.

BACKGROUND OF THE INVENTION

The present invention relates to the manufacture of containers. In another aspect, the present invention relates to an improved method of manufacturing flexible containers for use in the transportation, storage and handling of flowable materials.

Flowable materials, and particularly dry particulate materials present unique problems in their storage, transportation, dispensing and handling. These materials, for example, include chemicals, fertilizers, minerals, food stuffs, agricultural products, and the like.

One system of handling these materials utilizes an improved flexible receptacle which can be easily handled, has a large capacity, and provides top filling and bottom discharge. These receptacles utilize an outer protective covering of flexible sheet material which can be doubled for additional strength. A double-walled interior bag is provided which is formed from sheet material. A high strength filament is wound in a helix around the exterior surface of a double-walled interior bag and is secured thereto by a non-curing mastic adhesive. A sling of flexible webbing material forms a frame for the receptacle and has an inner ring which supports the bottom of the receptacle and an outer, larger ring which is positioned above the inner ring to prevent formation of pockets in the container and to facilitate complete unassisted discharge of the materials from the container. Loops of the webbing interattach the upper and lower rings. The loops are attached to the inside of the outer protective covering and extend above the top thereof for use in supporting the receptacle by appropriate transporting apparatus. Removable wire ties are provided for closing the gathered ends of the top and bottom of the inner bag to allow top loading and bottom discharge of materials therein.

Although receptacles of this type have been quite adequate for handling bulk particulate materials, they have conventionally required substantial amounts of labor in their manufacture. Therefore, according to one feature of the present invention, an improved method of manufacturing a flexible material handling receptacle is disclosed.

According to a particular feature of the present invention, a method of manufacturing a receptacle having a double-walled interior bag with an outer protective covering formed from flexible sheet material is disclosed. A filament is wound in a helix around the exterior surface of the interior bag and a sling of webbing forms a frame for the receptacle. Removable wire ties are applied to the gathered ends of the interior bag to allow top loading and bottom discharge of the material therefrom.

More particularly, the present invention provides a method for fabricating receptacles for transporting dry flowable material wherein a first cylindrical wall of sheet material is located in a work area, a second cylindrical wall of sheet material is concentrically positioned around the first wall, and a filament is attached to the exterior of said second wall. A sling is then attached to the exterior of said second wall and the filament by an adhesive material. A protective covering is wrapped around the exterior of the sling, the filament and the second cylindrical wall, and the ends of the first and second cylindrical walls are gathered together and releasably closed with wire ties.

Two embodiments of the invention are disclosed. In one embodiment, the first and second walls are formed by wrapping a sheet around a mandrel to form two layers thereon, and slitting the interconnection between the layers adjacent to their opposite ends. In another embodiment, the first and second walls are formed by positioning tubular members one over the other on the mandrel.

BRIEF DESCRIPTION OF THE DRAWINGS

The features and advantages of the present invention will be readily appreciated by those of ordinary skill in the art as the same is explained by reference to the following detailed description when considered in connection with the accompanying Drawings in which.

DETAILED DESCRIPTION

Figure 1:
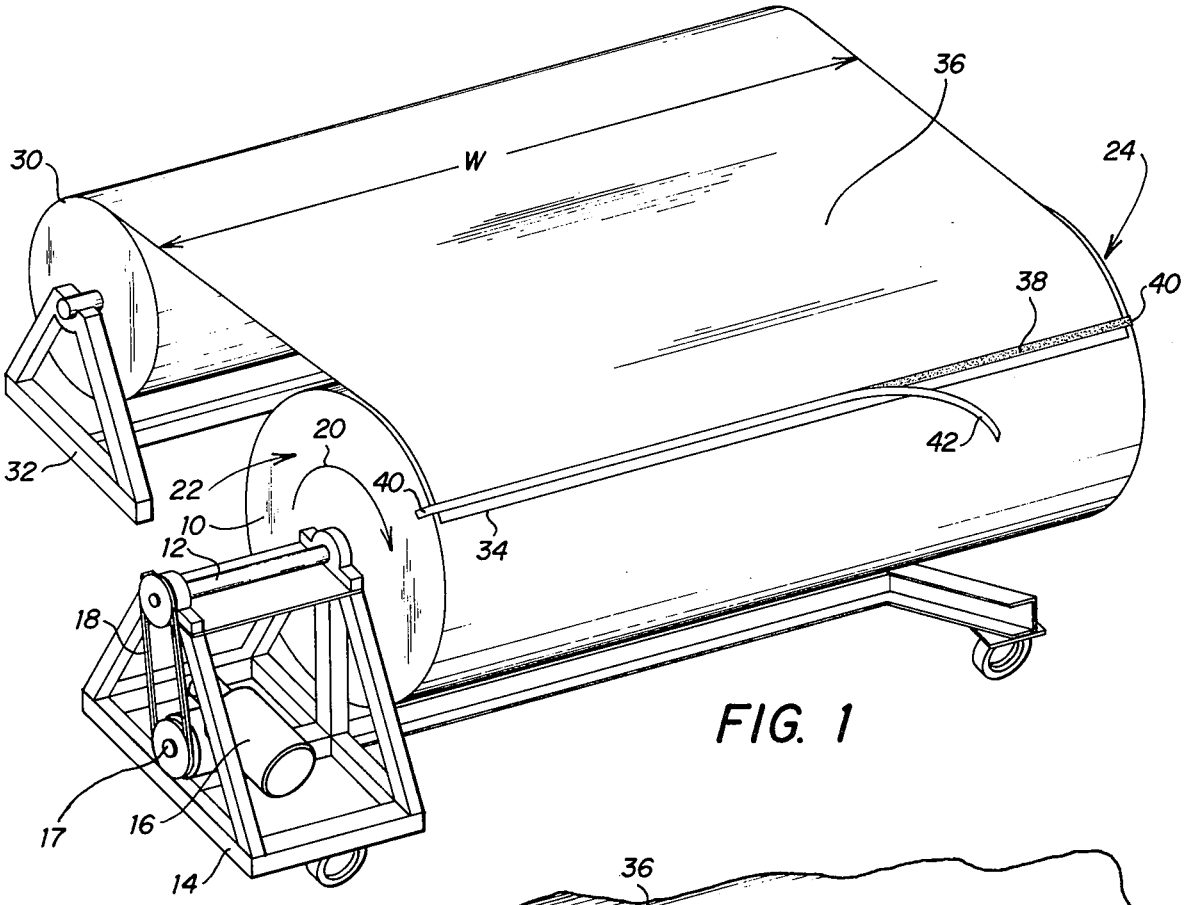
FIG. 1 is a perspective view of a sheet of material being wrapped onto a mandrel to form the inner bag.

Referring now to the drawings wherein like reference characters designate like or corresponding parts throughout the several views, there is illustrated in FIGS. 1–12, the steps used in forming a receptacle according to one embodiment of the improved method of the present invention. This receptacle has a double-walled inner bag portion, each wall of which can be releasably sealed by a wire tie at the top and the bottom thereof. A filament is wound in a helix around the exterior wall of the inner bag and a sling is attached to the exterior wall of the inner bag for supporting the bag. An outer protective cover surrounds the sling.

Turning to FIG. 1, the first step of the improved method of forming the receptacle will be explained. In FIG. 1, a mandrel 10 is shown supported in a cantilevered fashion from a shaft 12 which is rotatably attached to a frame 14. A suitable motor 16 is connected through a speed reducer 17 and an endless belt 18 to drive the shaft 12 to rotate in the direction of the arrow 20. It is to be pointed out that the motor is reversible and can be operated to rotate the shaft 12 in the reverse direction of the arrow 20.

The mandrel 10 is generally cylindrical in shape and has a diameter which corresponds to the ultimate inside diameter of the receptacle to be formed. This diameter can range from about 24 inches or smaller to about 60 inches or larger. The mandrel 10 is positioned so that the top of the receptacle will be formed at end 22 and the bottom of the receptacle will be formed at end 24.

A spool 30 of sheet material is shown supported from a frame 32 and positioned parallel to mandrel 10. The width "W" of the sheet material on the spool 30 is selected to correspond to the ultimate top to bottom length of the material forming the receptacle. This width can be from about 80 inches to about 140 inches. The material may be polyethylene, such as VALERON film, which is a registered trademark of Royal Packing Industries, Van Leer, New York, and is preferably 4 mils thick. Other materials, such as polybutylene film or the like can also be used, and the sheet material may comprise any flexible material having adequate strength for packaging, ranging from paper to coated fabrics.

In the manufacturing of the receptacle, an edge 34 of material 36 is positioned on the mandrel 10, as shown. A length of double-sided adhesive tape 38 is positioned across the width of the material 36 adjacent to the leading edge 34. The tape 38 is affixed to the material 36 with the ends 40 overlapping the ends of the mandrel 10, thereby securing the material 36 to the mandrel 10. The protective backing 42 is removed from the upper surface of the tape 38, as shown in FIG. 1.

Figure 2:
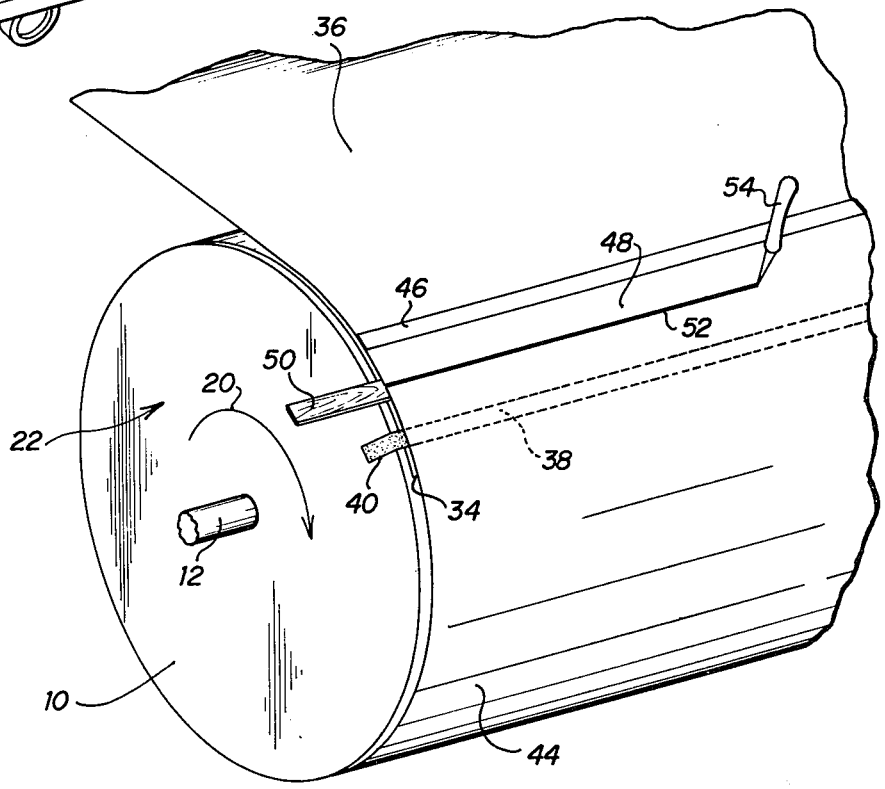
FIG. 2 is a detailed view of the top end of the bag showing the inner wall and a slit between the inner wall and the beginning of the outer wall.

The motor 16 is then energized to rotate the mandrel 10 in the direction of arrow 20, wrapping the material 36 completely about the mandrel until the material 36 overlaps the tape 38 and extends a short distance beyond, as shown in FIG. 2. The sheet material 36 adheres to the upper surface of the tape 38 to form the inner wall 44 of the inner bag portion. A second length of double-backed adhesive tape 46 is placed across the width of the material 36 along a line spaced away from the tape 38. A boundary area 48 is defined between tapes 38 and 46.

As illustrated in FIG. 2, a thin elongated guard 50, such as a yardstick, is inserted under the outer layer of sheet material in area 48, and a slit 52 is formed by a knife 54 in the area 48. This slit 52 typically does not extend along the complete length of the mandrel 10 and is preferably approximately 12 inches long. It will be understood that the slit may extend across the entire width of the material 36, if desired.

Figure 3:
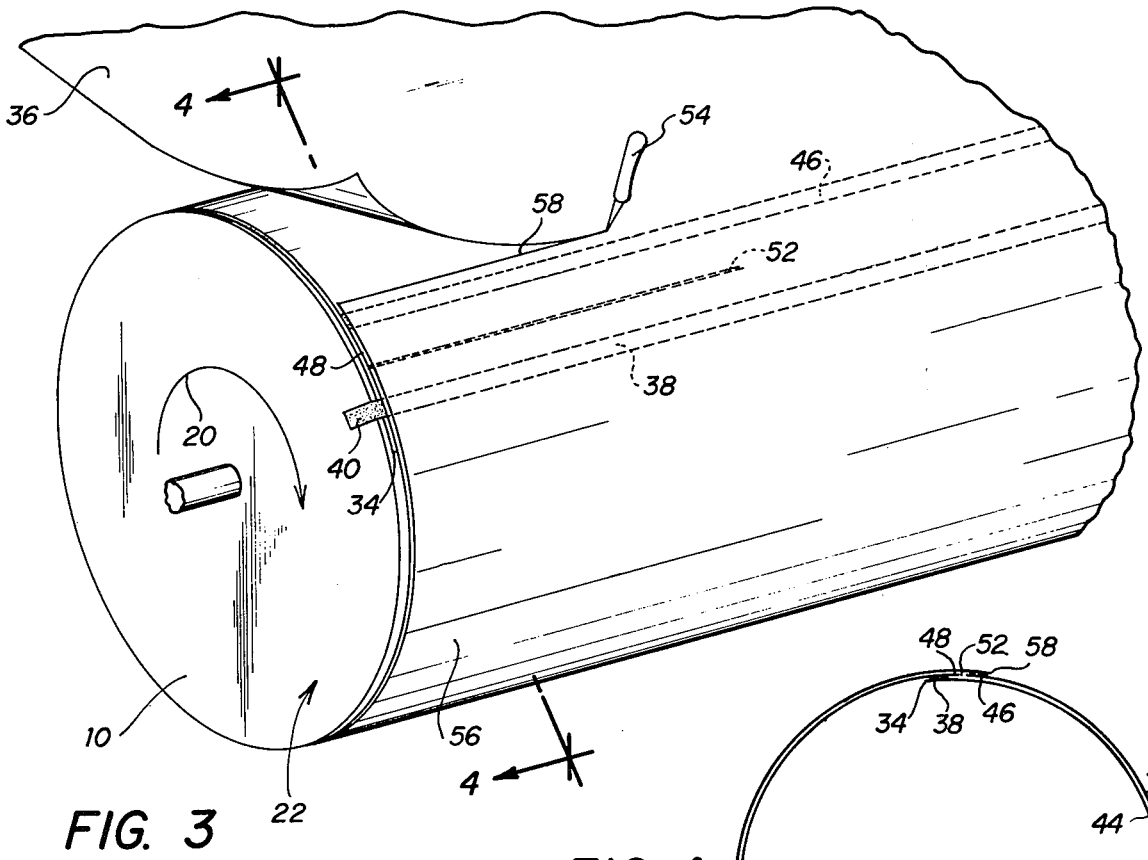
FIG. 3 is a perspective view similar to FIG. 2, showing the completion of wrapping of the outer wall, and severing of the sheet material from the outer wall.
Figure 4:
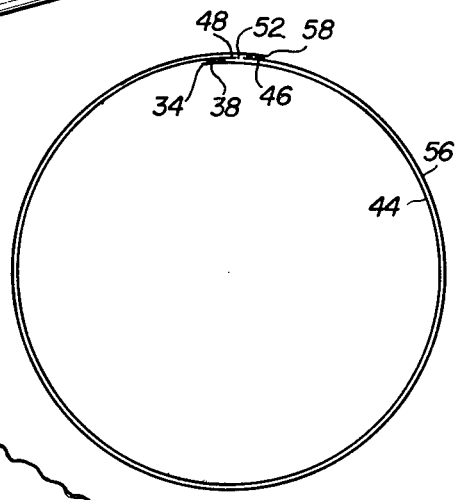
FIG. 4 is a sectional view taken on line 4—4 of FIG. 3, looking in the direction of the arrows.

Motor 16 is again energized rotating the mandrel 10 in the direction of arrow 20 to wrap the material 36 around the exterior of inner wall 44 to form an outer wall 56 of material 36. This outer wall 56 extends completely around the inner wall 44 and adheres to the upper surface of the tape 46 as shown in FIGS. 3 and 4. The material 36 is then severed from the wall 56 by knife 54 to form an outer edge 58, extending along and parallel to the tape 46. Thus, a double-walled receptacle is formed of the material 36 which is separated in area 48 by slit 52 at the top end of the receptacle.

Figure 5:
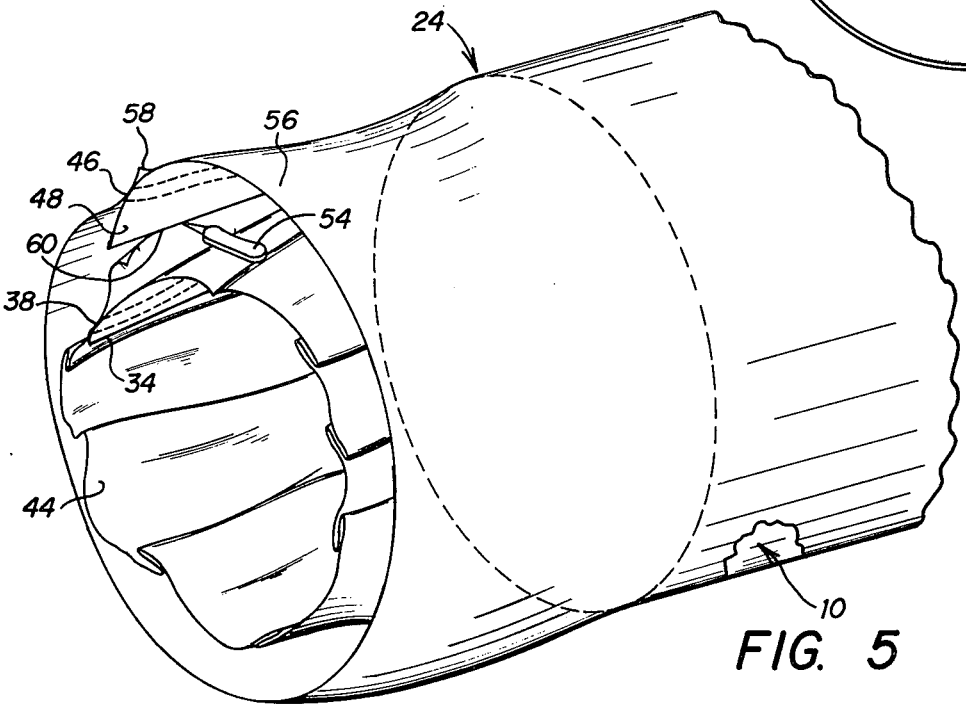
FIG. 5 is a perspective view of the bottom of the bag illustrating severing of the material between the inner and outer walls of the inner bag with the bottom of the bag pulled off the end of the mandrel.

The next step in the method of the present invention is illustrated in FIG. 5. In this Figure, the inner and outer walls 44 and 56, respectively, are pulled a short distance off the bottom end 24 of the mandrel 10. The walls 44 and 56 are separated, and knife 54 is used to form a slit 60 in the bondary area 48 at the bottom end. This slit 60 extends along the length of the area 48 a distance in the range of about 10 inches to about 15 inches.

Figure 6:
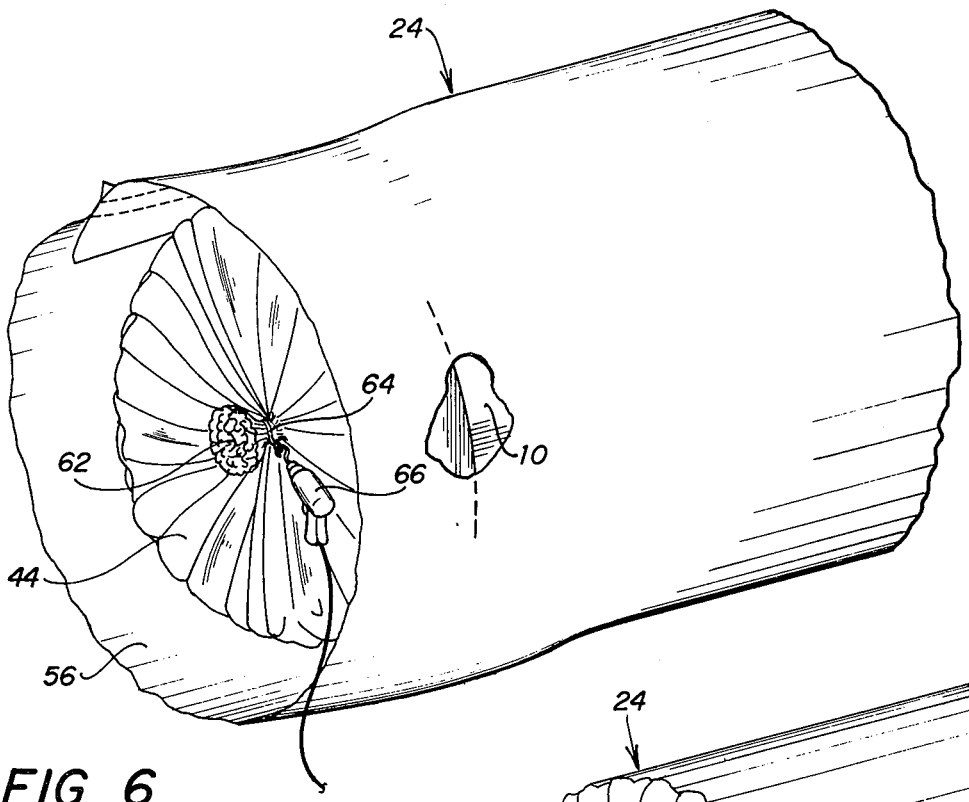
FIG. 6 is a perspective view of the bottom of the bag illustrating the gathering and tying off of the inner wall.

After the slit 60 is formed, the inner wall 44 is gathered, as illustrated in FIG. 6 in a portion 62 to seal off the bottom end of the inner wall 44. A wire tie 64 is placed around the neck of the gathered portion 62 and a power drill 66 with a hook mounted in the chuck engages the tie 64 and bends the same to seal the gathered portion 62 in a closed position.

Figure 7:
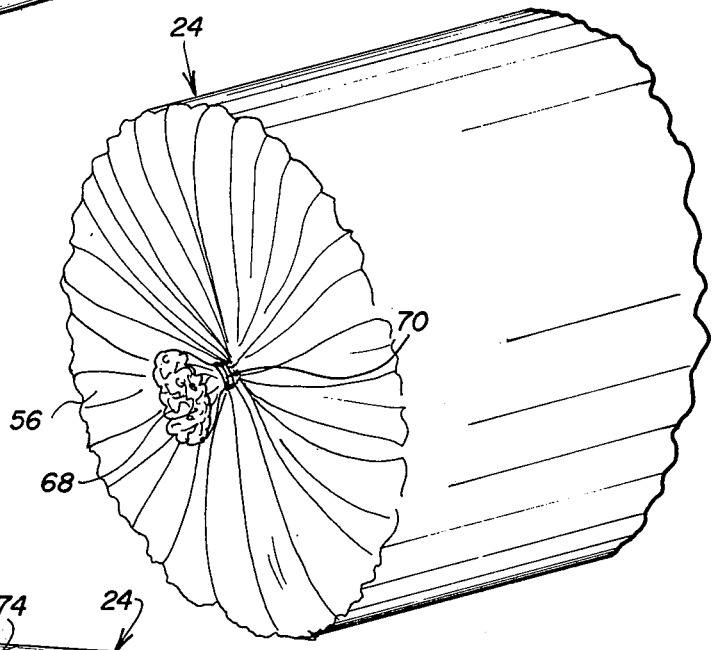
FIG. 7 is a perspective view of the bottom of the bag with the outer wall of the inner bag shown gathered and tied off.

Next, the outer wall 56 is gathered at 68 and a wire tie 70 is installed on the neck of the gathered portion 68, as is illustrated in FIG. 7. This seals the outer wall 56 along the bottom thereon. The walls 44 and 56 are then pulled back onto the mandrel 10 until they are flush with the end as illustrated in FIG. 7.

Figure 8:
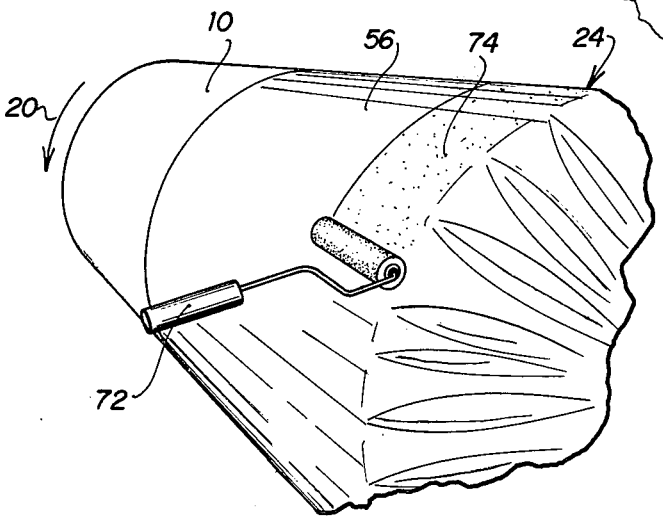
FIG. 8 is a perspective view illustrating the application of adhesive to the outer wall of the inner bag.

Next, the motor 16 is energized rotating the mandrel 10 in the reverse direction of arrow 20 while a roller 72 is used to apply an adhesive 74 to the exterior of the exterior wall 56. This is illustrated in FIG. 8. This adhesive typically is a mastic type, such as a latex.

Figure 9:
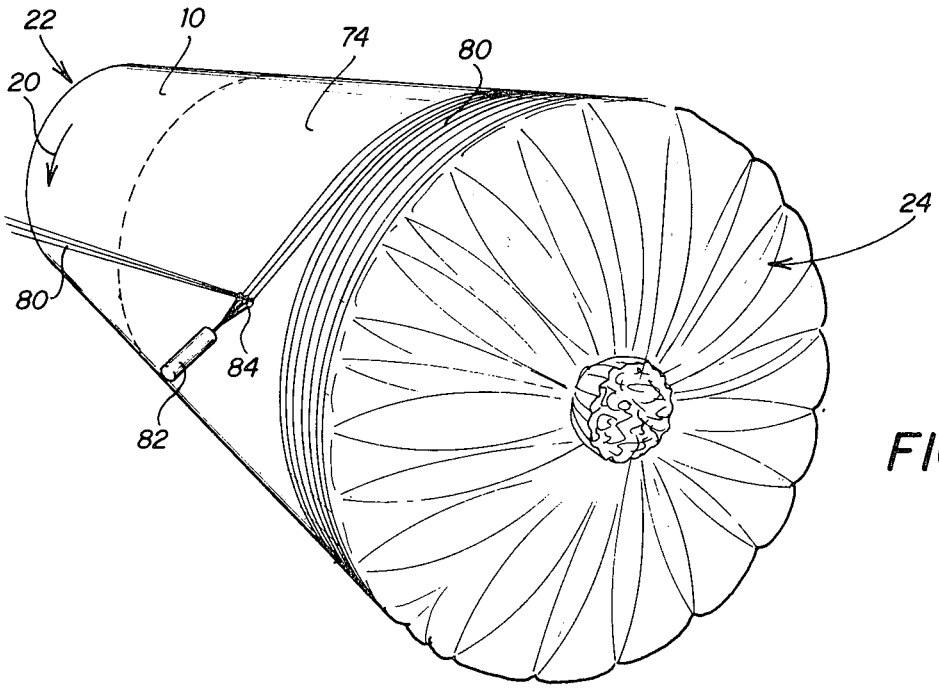
FIG. 9 is a view similar to FIG. 8, illustrating the winding of the filament materials in a helix about the exterior of the outer wall of the inner bag.
Figure 10:
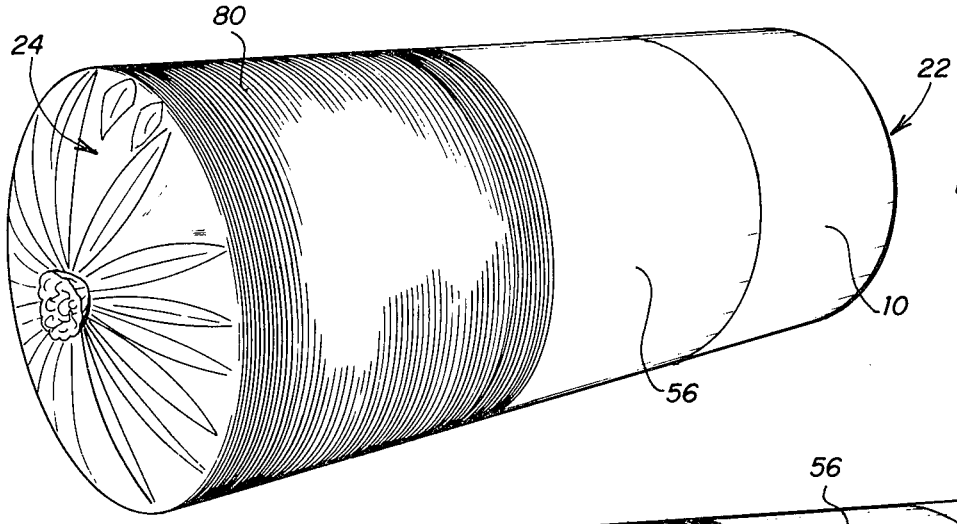
FIG. 10 is a perspective view showing the outer wall of the inner bag with the filament material wound thereon.

Once the adhesive is applied, the mandrel 10 is rotated in the reverse direction of arrow 20, as shown in FIG. 9. A polyester filament material 80 is wrapped in a helix around the exterior wall 56 in the area where the adhesive 74 has been applied. A guide tool 82 is utilized in wrapping the material 80 onto wall 56. The tool 82 has a plurality of eyes 84 through which the filament 80 extends wherein the eyes 84 function as the guides for positioning the material 80 on the wall 56. In FIG. 10, the material 80 is illustrated attached to the wall 56 in the area where the adhesives 74 are applied. The helical arrangement of the material 80 can be seen in FIG. 10.

Figure 11:
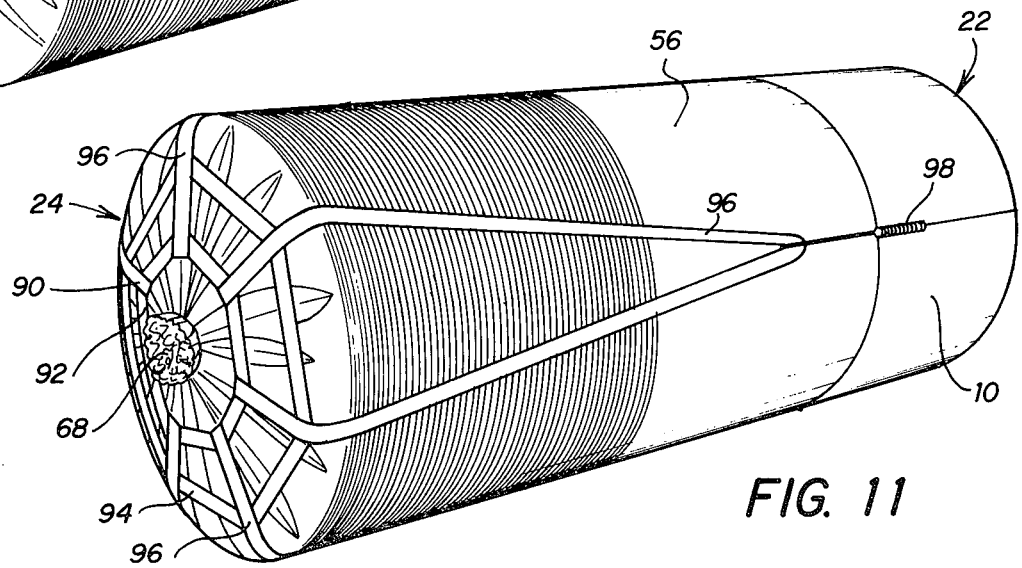
FIG. 11 is a perspective view of the bottom of the bag illustrating the harness fitted over the exterior of the outer wall of the inner bag.

Upon completion of attaching the material 80, a sling assembly 90 is placed over the wall 56, as illustrated in FIG. 11. The sling assembly 90 is positioned around the exterior of a wall 56 for use in supporting and transporting a receptacle. The sling assembly 90 has an inner ring 92 supporting the bottom of the bag. This inner ring and the remainder of the sling 90 is preferably made from polyester webbing. A larger diameter ring 94 is positioned concentric with the inner ring 92. Rings 92 and 94 are attached together as shown by three separate strips of webbing material sewn to the rings 92 and 94 to form three loops 96. The strips of webbing forming loops 96 have their ends sewn or fixed to the inner ring at concentric spaced points and are sewn to the outer ring 94 at concentric spaced points. The sling assembly 90 is attached to the exterior of outer wall 56 by adhesive 74 with the gathered portion 68 extending through the center of ring 92. The loops 96 pass up along the side of the wall 56. The sling assembly 90 is held in position on the mandrel by spring clamps 98 attached between the mandrel end 22 and the support loops 96.

Figure 12:
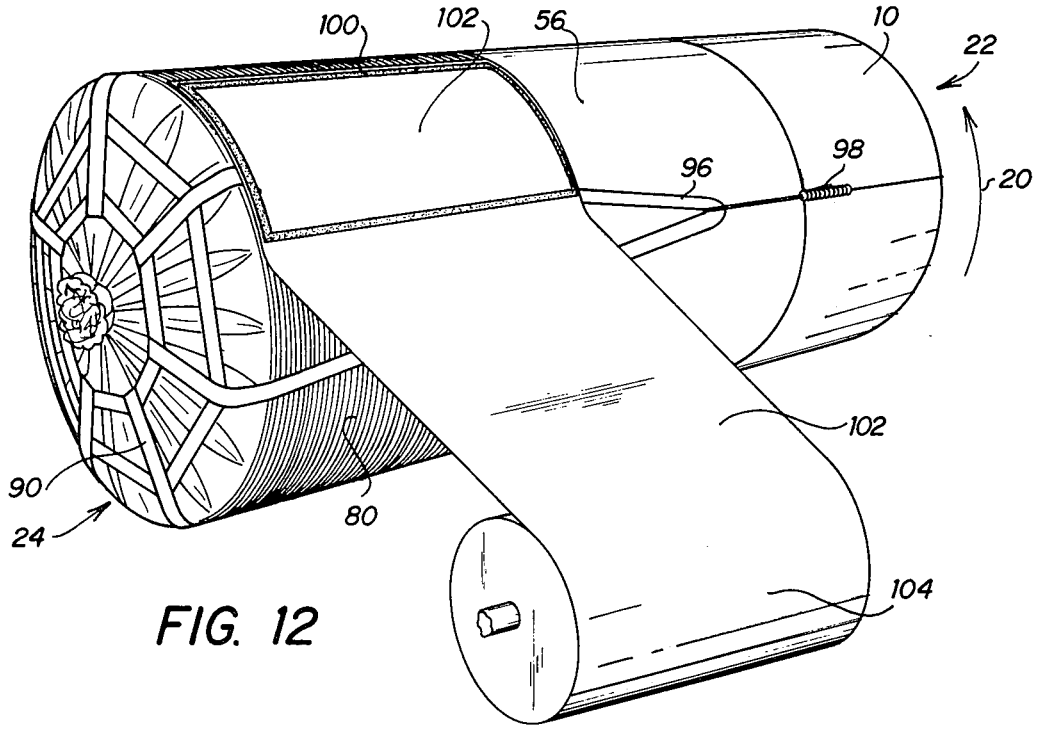
FIG. 12 is a perspective view illustrating the attachment of the outer protective covering over the filament, sling and outer wall of the inner bag.

Once the sling assembly 90 is in the position shown in FIG. 11, the outer covering is attached. This attachment of the outer covering is illustrated in FIG. 12. In this Figure, it can be seen that strips of double-backed tape 100 are applied on the outer surface of a length of outer covering material 102. In the embodiment illustrated, the strips 100 are positioned in rectangular panels extending along the length of the receptacle corresponding to the width of the outer covering material 102. The cover material 102 is unrolled from a storage spool 104 and the mandrel 10 is rotated in the direction of arrow 20 to wrap the cover material 102 about the exterior as illustrated. The material 102 is extended over the tape 100 and is secured thereby.

Once the cover material 102 is completely wrapped around the exterior of the outer wall 56, the material 102 is severed, the spring clamps 98 are removed, and the completed receptacle is removed from the mandrel 10. Thus, it can be seen that a simple and efficient method of forming the disclosed receptacle is described.

It is to be understood, of course, that the outer protective cover and the inner and outer walls of the bag can be constructed from polyethylene sheet material, such as VALERON film, which is a registered trademark of Royal Packing Industries, Van Leer, New York. It is also envisioned that other materials could be used, such as polybutylene film, or the like. The VALERON material is preferably 4 mils thick. The sling is preferably constructed from polyester material, 2 inches wide, 1/16 of an inch thick, and with a 5,000 lb. tensile strength.

Figure 13:
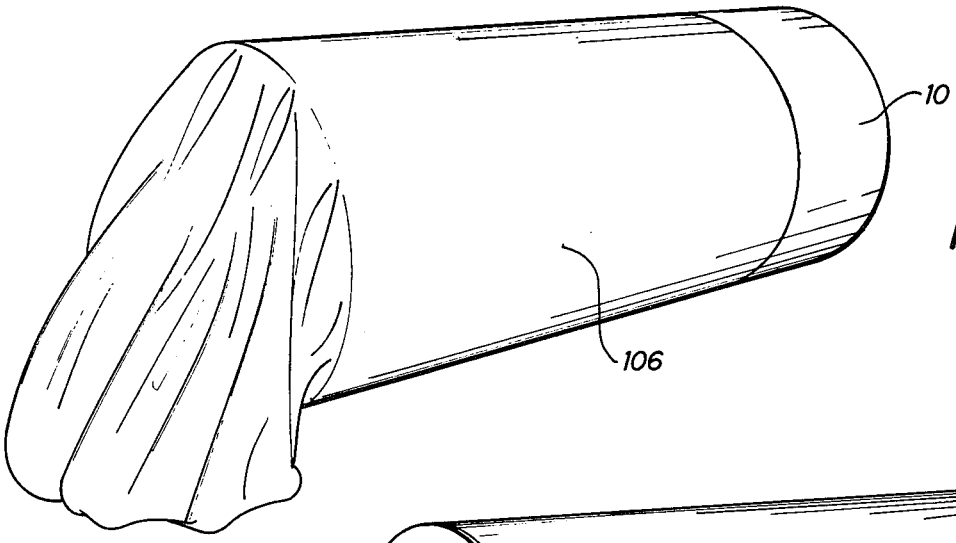
FIG. 13 is a perspective view of an alternate method of forming the inner bag.
Figure 14:
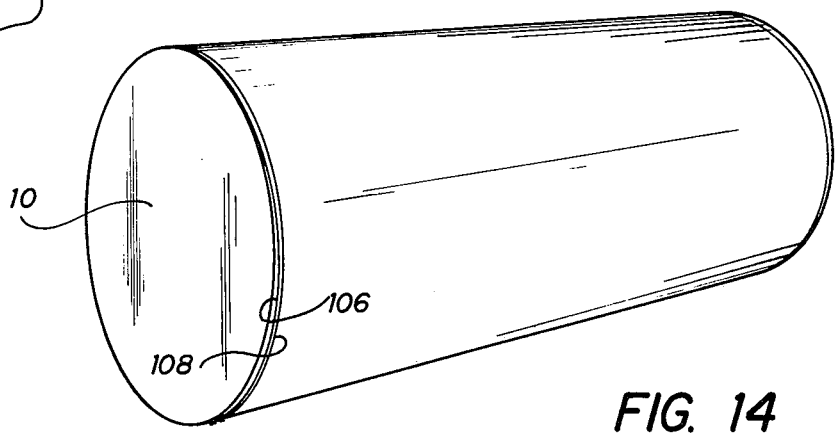
FIG. 14 is a perspective view of the alternate embodiment illustrating the two walls of the inner bag installed on a mandrel.

In FIGS. 13 and 14, an alternate embodiment of the method of constructing the receptacle of the present invention is illustrated. In this embodiment, the mandrel 10 is again used. In this embodiment, a cylindrical or tubular sheet 106 of material is pulled over the mandrel 10 to form the inner wall of the bag. Thereafter, a second cylindrical or tubular sheet 108 of material is pulled over the mandrel 10 and the inner wall. Thus, the inner and the outer walls are formed on the mandrel and the process can be performed identical to the first embodiment as illustrated in respect to FIGS. 6–12. It is also envisioned that the outer protective covering could be in the form of a cylindrical or tubular sheet pulled onto the mandrel.

It is to be understood, of course, that the foregoing disclosures relate only to specific embodiments of the present invention. In view of the foregoing disclosure, it is understood, of course, that many other embodiments of the present invention could be used without departing from the spirit and scope of the invention as defined in the appended claims.

I claim:

1. A method of forming a receptacle on a cylindrical mandrel comprising the steps of:

a. positioning a first tubular polyethylene sheet concentrically on the mandrel to form a first cylindrical wall;

b. positioning a second tubular polyethylene sheet concentrically around the first wall to form a second cylindrical wall;

c. gathering and tying one end of the first and second walls to close one end of the walls;

d. rotating the mandrel and applying adhesive to the exterior of the second wall;

e. wrapping a polyester filament in a helix about the second wall in the area of the adhesive;

f. positioning a sling around the exterior of the second wall with the gathered ends of the first and second walls within first and second concentric circular portions on the sling, and with support loops of the sling joined to the circular portions and extending up along the exterior surface of the second wall;

g. attaching double-backed adhesive tape around the exterior of the sling filament and second wall;

h. wrapping an outer covering around the exterior of the double-backed adhesive tape to form an outer protective covering; and i. removing the receptacle from the mandrel.

2. A method of forming a receptacle comprising the steps of:

locating a first cylindrical wall of sheet material in a work area;

positioning a second cylindrical wall of sheet material concentrically around said first wall;

attaching a filament material to the exterior of said second wall;

positioning a sling around the exterior of said second wall;

said sling positioning step comprising:

first gathering and closing the ends of one end of said first and second walls;

placing the gathered ends of said first and second walls within concentric circular portions on said sling and with support loops joined to said circular portions and extending along the exterior surface of said second wall; and positioning a third cylindrical wall of sheet material concentric with said second wall and around the exterior of said sling.

3. The method of claim 2 additionally comprising the step of attaching said sling to the exterior of said second wall.

4. A method of forming a receptacle comprising the steps of:

a. locating a first cylindrical wall of sheet material in a work area;

b. positioning a second cylindrical wall of sheet material concentrically around said first wall;

c. attaching a filament material to the exterior of said second wall to define the body of the receptacle;

d. positioning a sling around the exterior of said second wall with the sling extending longitudinally along the body of the receptacle from one end thereof to the other;

e. positioning a third cylindrical wall of sheet material concentric with said second wall and around the exterior of said sling; and f. releasably closing the ends of one end of said first and second walls.

5. The method of claim 1 wherein the step of attaching filament material to the exterior of said second wall comprises:

adhesively attaching said filament to said exterior surface of said second wall.

6. The method of claim 1 wherein the step of attaching filament material to the exterior of said second wall comprises:

applying adhesive to the exterior surface of said second wall; and positioning said filament in said adhesive and around said second wall.

7. The method of claim 6 additionally comprising positioning said filament material in a helix around said second wall.

8. The method of claim 1 additionally comprising positioning said filament material in a helix around said second wall.

9. The method of claim 1 wherein the step of attaching the filament material to the exterior of said second wall comprises:

rotating said second wall;

winding said filament onto the exterior of said second wall; and advancing said filament progressively along the length of said second wall to form a helix.

10. The method of claim 1 wherein the step of releasably closing the ends of said first and second walls comprises:

gathering each end of said first wall, and tying around each gathered end of said first wall.

11. The method of claim 10 additionally comprising:

gathering each end of said second wall, and tying around each gathered end of said second wall.

12. The method of claim 1 wherein the step of locating said first wall comprises positioning said first wall about a cylindrical mandrel.

13. The method of claim 1 additionally comprising the step of:

forming said first and second cylindrical walls by wrapping a length of sheet material about a mandrel.

14. The method of claim 13 additionally comprising the step of adhesively attaching an overlapping portion of said sheet material wrapped about said mandrel to form said first wall and adhesively attaching an overlapping portion of said sheet material wrapped about said mandrel to form said second wall.

15. The method of claim 13 additionally comprising severing at least a portion of said sheet material between said first and second walls.

16. The method of claim 1 additionally comprising the steps of:

positioning the leading transverse edge of a length of sheet material on a mandrel;

affixing a first length of double-backed adhesive tape along said leading edge of said sheet material;

wrapping the same length of sheet material about said mandrel to overlap and adhere said material over said first length of adhesive tape to form a first cylindrical wall;

applying a second length of double-backed adhesive tape on the exterior of the portion of the same length of sheet material extending from said first wall; and wrapping said extending portion of the same length of sheet material about said first cylindrical wall to overlap and adhere said material to said second length of adhesive tape to form a second cylindrical wall.

17. A method of forming a double-walled receptacle on a mandrel comprising the steps of:

a. positioning a leading transverse edge of a length of sheet material along the length of the mandrel;

b. wrapping the length of sheet material around the mandrel to overlap the leading edge;

c. attaching the overlapping portion of said length of sheet material to the leading edge to form a first wall;

d. wrapping the same length of sheet material completely about the first wall to form a second overlapping portion; and e. attaching the second overlapping portion of the length of sheet material to the first wall to form a second wall.

18. The method of claim 17 wherein attaching the overlapping portion comprises attaching the overlapping portion to the leading edge completely along the length of said edge.

19. The method of claim 17 wherein attaching the second overlapping layers together comprises attaching the second overlapping layers of the material together completely along their width.

20. The method of claim 17 additionally comprising severing at least a portion of the material between said first and second walls.

21. The method of claim 20 wherein the severing is performed at the edges of said material.

22. The method of claim 17 additionally comprising:

releasably closing the ends of one end of said first and second walls.

23. The method of claim 17 additionally comprising attaching a filament material to the exterior of said second wall.

24. The method of claim 23 additionally comprising advancing said filament to form a helix at the exterior of said second wall.

25. The method of claim 17 additionally comprising the step of:

gathering the ends of one end of said walls; and tying around each gathered end of said walls.

26. The method of claim 23 wherein the step of attaching filament material to the exterior of said second wall comprises:

applying adhesive to the exterior surface of said second wall; and positioning said filament in said adhesive and around said second wall.

27. The method of claim 17 additionally comprising the step of placing a sling around the second wall.

28. The method of claim 27 wherein said step of placing a sling around the second wall comprises:

first gathering and closing one end of said first and second walls;

said sling having first and second concentric circular portions joined together by radially extending support loops; and placing the gathered ends of said first and second walls within said concentric circular portions with the support loops extending along the exterior surface of said second wall.

29. The method of claim 28 additionally comprising the step of attaching said sling to the exterior of said second wall.

30. A method of forming a receptacle on a cylindrical mandrel comprising the steps of:

a. positioning a leading transverse edge of a polyethylene sheet on the mandrel;

b. affixing a length of double-backed adhesive tape adjacent to said leading edge to attach said leading edge to the mandrel;

c. rotating the mandrel to wrap the sheet material about the mandrel to overlap and adhere said length of sheet material to the first length of adhesive tape to form a first cylindrical wall;

d. affixing a second length of double-backed adhesive tape on the exterior of the same length of sheet material extending from the first wall;

e. severing the sheet material in the area between the two lengths of double-backed adhesive tape;

f. rotating the mandrel to wrap the same length of sheet material about the exterior of the first wall to overlap and adhere said length of sheet material to the second length of adhesive tape to form a second cylindrical wall;

g. severing the sheet material from the second wall;

h. gathering and tying one end of the first and second walls to close one end of the walls;

i. rotating the mandrel and applying adhesive to the exterior of the second wall;

j. wrapping a polyester filament in a helix about the second wall in the area of the adhesive;

k. positioning a sling around the exterior of the second wall with the gathered ends of the first and second walls within first and second concentric circular portions on the sling, and with support loops of the sling joined to the circular portions and extending up along the exterior surface of the second wall;

l. attaching double-backed adhesive tape around the exterior of the sling, filament and second wall;

m. wrapping an outer covering around the exterior of the double-backed adhesive tape to form an outer protective covering; and n. removing the receptacle from the mandrel.

* * * * *

UNITED STATES PATENT OFFICE

CERTIFICATE OF CORRECTION

Patent No. 3,962,959 Dated June 15, 1976

Inventor(s) ROBERT R. WILLIAMSON

It is certified that error appears in the above-identified patent and that said Letters Patent are hereby corrected as shown below:

Column 6, line 55 (Claim 5) "1" should be --4--;
Column 6, line 60 (Claim 6) "1" should be --4--;
Column 7, line 4 (Claim 8) "1" should be --4--;
Column 7, line 7 (Claim 9) "1" should be --4--;
Column 7, line 23 (Claim 12) "1" should be --4--;
Column 7, line 26 (Claim 13) "1" should be --4--;
Column 7, line 40 (Claim 16) "1" should be --4--.

Signed and Sealed this

Seventh Day of September 1976

[SEAL]

*Attest:*

RUTH C. MASON
*Attesting Officer*

C. MARSHALL DANN
*Commissioner of Patents and Trademarks*